US007591225B1

(12) United States Patent
Cope et al.

(10) Patent No.: US 7,591,225 B1
(45) Date of Patent: Sep. 22, 2009

(54) FUZE MODULE

(75) Inventors: Randall D. Cope, Ridgecrest, CA (US); Gabriel H. Soto, Ridgecrest, CA (US); John K. Kandell, Ridgecrest, CA (US); Brian D. Dutton, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 18 days.

(21) Appl. No.: 11/779,622

(22) Filed: Jul. 18, 2007

Related U.S. Application Data

(62) Division of application No. 11/264,335, filed on Oct. 27, 2005, now abandoned.

(51) Int. Cl.
*F42C 15/40* (2006.01)
*F42C 17/00* (2006.01)

(52) U.S. Cl. ..... 102/221; 89/6.5

(58) Field of Classification Search ..... 89/6, 89/6.5; 102/275.9, 221
See application file for complete search history.

(56) References Cited

U.S. PATENT DOCUMENTS

| | | | | | |
|---|---|---|---|---|---|
| 4,091,734 | A * | 5/1978 | Redmond et al. | ..... | 102/207 |
| 4,454,815 | A * | 6/1984 | Beck | ..... | 102/206 |
| 4,495,851 | A * | 1/1985 | Koerner et al. | ..... | 89/6.5 |
| 4,736,681 | A * | 4/1988 | Hall et al. | ..... | 102/215 |
| 5,397,079 | A * | 3/1995 | Strentz et al. | ..... | 244/3.2 |
| 5,585,592 | A * | 12/1996 | Stearns et al. | ..... | 102/233 |
| 6,189,430 | B1 * | 2/2001 | Vornfett | ..... | 89/6.5 |
| 6,216,595 | B1 * | 4/2001 | Lamorlette et al. | ..... | 102/270 |
| 6,268,785 | B1 * | 7/2001 | Kollman et al. | ..... | 336/83 |
| 6,666,123 | B1 * | 12/2003 | Adams et al. | ..... | 89/6.5 |
| 6,823,767 | B2 * | 11/2004 | Vornfett et al. | ..... | 89/6.5 |
| 2003/0221546 | A1 * | 12/2003 | Adams et al. | ..... | 89/6 |

* cited by examiner

*Primary Examiner*—Bret Hayes
(74) *Attorney, Agent, or Firm*—Brian F. Drazich; Christopher L. Blackburn

(57) ABSTRACT

A self-contained fuze module, for installation on pieces of ordnance, having sensing devices and processing capability within the fuze module to determine whether conditions have been met to arm the ordnance. The fuze module is a unitary sealed module communicating with a launch vehicle via one or more communication/power buses.

5 Claims, 4 Drawing Sheets

FUZE MODULE

This application is a divisional of U.S. patent application Ser. No. 11/264,335, filed Oct. 27, 2005, now abandoned.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The embodiments of the invention relate generally to fuzes in weapon systems.

BACKGROUND OF THE INVENTION

Fuzes used in weapon systems are required to sense the presence of two independent and unique environments before arming. Sensing of these environments ensures that the weapon system has safely separated from the launch vehicle or platform before the fuze is armed and capable of initiating the warhead. Arming of the fuze prior to safe separation from the aircraft could potentially be catastrophic to the launch vehicle and personnel.

It has historically been difficult for fuzes on free fall weapons to detect two unique and independent environments resulting from safe release and safe separation from the aircraft. Existing fuzes rely on sensors located external to the fuze to sense safe separation. Relying on these external sensors has resulted in a fuze that is less safe and less reliable than fuzes used in other weapon systems. Reliability is important to ensure mission success. In addition, there is an increased need for improved reliability in all explosive weapons as unexploded ordnance is now being used by insurgents to create Improvised Explosive Devices (IEDs).

BRIEF DESCRIPTION OF THE EMBODIMENTS

Embodiments of the invention include: a high reliability fuze module having a means to transfer data and power between a launch vehicle and the fuze module; a means for operating the fuze module; a plurality of sensors located within the fuze module operatively connected to the means for operating the fuze module with the fuze module being a sealed unitary structure located within a weapon; the plurality of sensors detecting a plurality of conditions required for an arming of the weapon; and the means for operating the fuze module receiving a plurality of data from a guidance system on the weapon, the fuze module being armed or rendered safe by the means for operating the fuze module according to the plurality of conditions detected by the plurality of sensors and the plurality of data received from the guidance system on the weapon.

DESCRIPTION OF THE EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation. In the figures, the same reference numbers are used to identify the same components.

Embodiments of the invention include a high reliability fuze module and a method for using the same. Embodiments of the invention include a self-contained fuze module, for installation on pieces of ordnance (weapons), having sensing devices and processing capability within the fuze module to determine whether conditions have been met to arm the ordnance. The fuze module is sealed and communicates with a launch vehicle via one or more communication/power buses. Embodiments of the invention meet a need for simpler and more reliable arming of ordnance.

Figure 1:
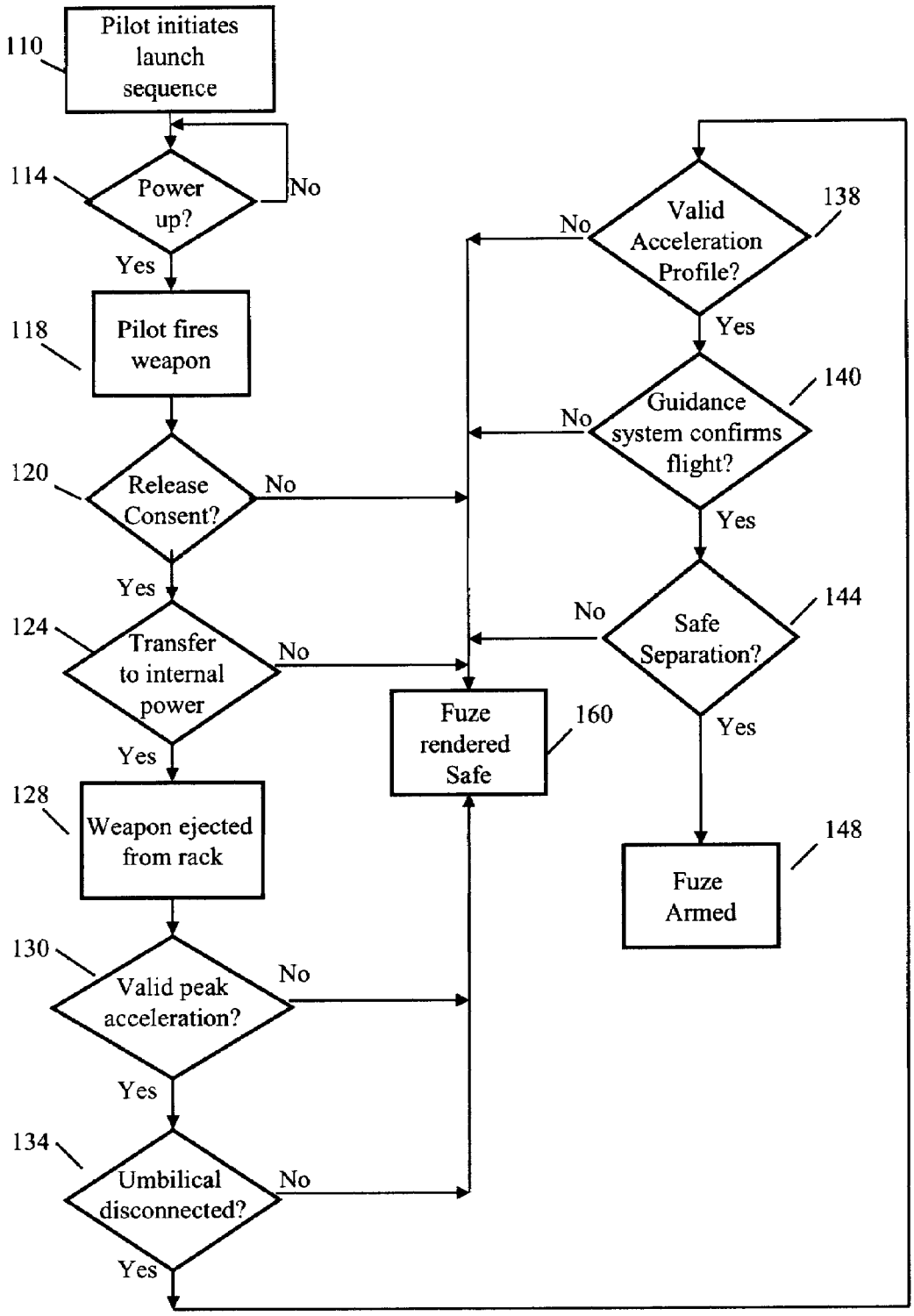
FIG. 1 is a functional flow chart of the operation of a fuze module according to an embodiment of the invention.

FIG. 1 shows a functional flowchart of the operation of a fuze module according to one embodiment of the invention. The fuze module (not shown) is installed on board a weapon (such as, for example, a Joint Direct Attack Munition (JDAM)) as a complete, sealed, unitary module, thereby allowing for simple installation or replacement of the unitary fuze module. The fuze module is connected to the launch vehicle utilizing means to transfer data and power between the launch vehicle and the fuze module. The transfer of data and power may be accomplished by a communication/power bus (such as, for example, a MIL-STD-1760 bus interface, not shown). A processor (not shown) provides means for operating the fuze module.

In an embodiment illustrated by FIG. 1, a launch sequence is initiated 110 (for example, by a pilot in an aircraft) that will cause the aircraft to provide DC power to the weapon 114. This powers up the portion of the fuze module used for data communication components and allows the fuze module to detect the Release Consent (RC) signal 120 that is generated when the pilot releases the weapon 118. In one embodiment, 28 V DC power from the MIL-STD-1760 interface powers the data communication functions within the fuze module. Within 20 milliseconds of receiving the RC signal, the weapon's thermal battery (not shown) activates and powers the weapon. Once the battery is online (1 second of activation), the aircraft will remove DC power and RC from the weapon, thereby relying on the weapon's internal power from the thermal battery. The fuze module detects the activation of the thermal battery and the removal of these signals 124. (It is noteworthy that throughout the embodiments of the invention, if required conditions are not seen in order or within the correct time frame, the fuze module will be rendered safe 160).

A plurality of sensors (not shown) located within the fuze module detects conditions required to arm the weapon. In one embodiment the conditions may include a peak acceleration from a launching rack, an acceleration profile, weapon being in flight, and safe separation reached from the launching vehicle. The sensors interact with the programming within the fuze module's processor. When the weapon is ejected from the aircraft 128 the fuze module will detect peak acceleration after initiation of the weapon rack squibs 130. The fuze module waits a maximum time to detect a peak acceleration caused by the firing of ejector cartridges (squibs) and ejection from the rack 128. In one embodiment, accelerometer sensors are used to collect peak acceleration 130 data over several seconds to determine a weapon acceleration profile. This profile is used by the fuze module to determine whether a good separation from the aircraft has occurred. For example, the fuze module will be rendered safe if the weapon were to "hang" on one of its lugs on the rack. The fuze module will render itself safe 160 for any abnormal characteristic within the profile.

As the weapon leaves the rack the physical means to transfer data and power between the launch vehicle and the weapon, known as an umbilical, shall be disconnected 134. In one embodiment the fuze module shall detect the umbilical disconnect from the address lines of the MIL-STD-1760 interface going "high". The fuze module then monitors the weapon's acceleration for several seconds to determine if the acceleration profile created matches a valid acceleration profile 138. The fuze module processor receives a plurality of data from the weapon's guidance system. The fuze module waits for data signals from the weapon guidance section indicating the weapon is in flight 140. If this data is not seen within a valid time window the fuze module will render itself safe 160. If all prior conditions have been met the fuze module will arm 148 after a safe separation distance from the launch vehicle has been achieved and detected 144. If any portion of this sequence is not detected within the appropriate time frame the fuze module will be rendered safe 160.

Figure 2:
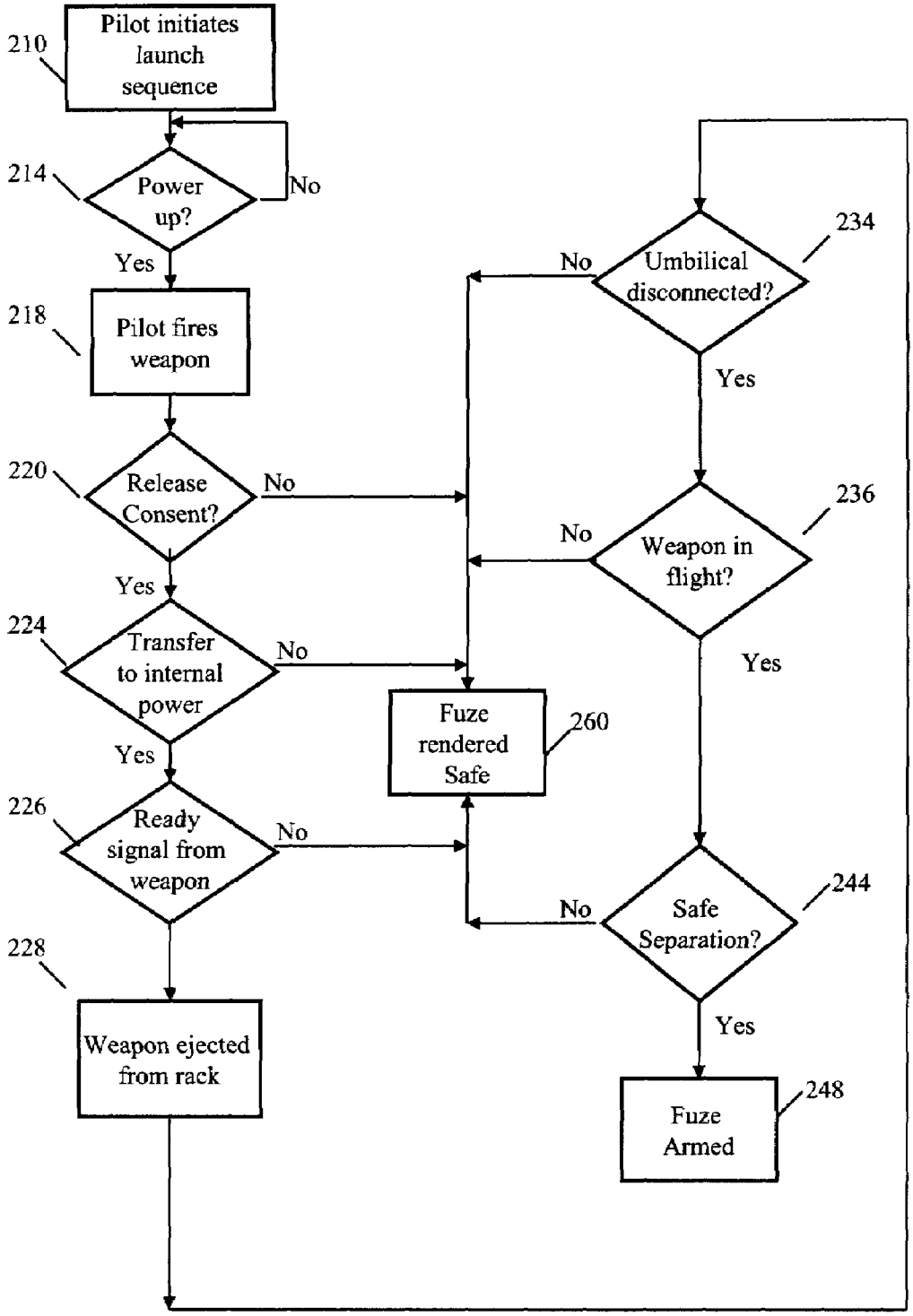
FIG. 2 is a functional flow chart of the operation of a fuze module according to another embodiment of the invention.

FIG. 2 shows a functional flowchart of the operation of another embodiment of the invention. As previously discussed, in one embodiment a launch sequence is initiated 210 that causes the aircraft to provide 28V DC power to the weapon 214. This powers up the portion of the fuze module used for data communication components and allows the fuze module to detect the Release Consent (RC) signal 220 that is generated when the pilot releases the weapon 218. Within 20 milliseconds of receiving the RC signal, the weapon's thermal battery (not shown) activates and powers the weapon. Once the battery is online (1 second of activation), the aircraft will remove DC power and RC from the weapon, thereby relying on the weapon's internal power from the thermal battery. The fuze module detects and monitors the activation of the thermal battery and the removal of these signals 224.

In one embodiment there is additional communication between the aircraft launch vehicle and the weapon on the MIL-STD-1553 bus prior to ejection of the weapon. The fuze module shall monitor MIL-STD-1553 bus for a final Committed to Store Separation (CTSS) signal from the weapon. The weapon sends an 11 T signal to the aircraft containing the CTSS word within it. This word will become true when the thermal battery is activated and will again be sent true when the power changeover occurs successfully from aircraft power to weapon power 224. The fuze module monitors the MIL-STD-1553 bus for this signal 226, which indicates that the next step is for the weapon to be ejected from the rack 228 (as previously discussed). If the CTSS signal returns to a false state after power changeover, the fuze module will be rendered safe 260.

Subsequently, the weapon is ejected from the rack 228 and the umbilical between the weapon and the aircraft is disconnected 234. As previously discussed, if the umbilical does not disconnect within a valid time window, the fuze module will be rendered safe 260.

In an embodiment the fuze module utilizes a plurality of data (arming data) including time to target or distance to target information that is available from the guidance system within the weapon. The fuze module collects this plurality of arming data from the weapon's guidance system and analyzes it. In this embodiment the conditions for the arming of the weapon may include the time to target, the distance to target, and valid guidance to the target. When a continuous decrease (decreasing trend) in the distance between the weapon and the target or a continuous decrease (decreasing trend) in the time it will take for the weapon to reach the target is detected the processor determines that the weapon has been released and is in flight to a target 236. The fuze module shall allow for slight increases in time or distance that may occur from retargeting, but an overall decrease shall exist when the weapon is progressing towards the target. Any erratic information or data that does not show a decrease in time or distance will result in the fuze module rendering itself safe 260. When a valid trend of decreasing distance and time to target is seen 236 and the weapon has reached safe separation distance 244 (as previously discussed) the fuze module shall arm 248.

Figure 3:
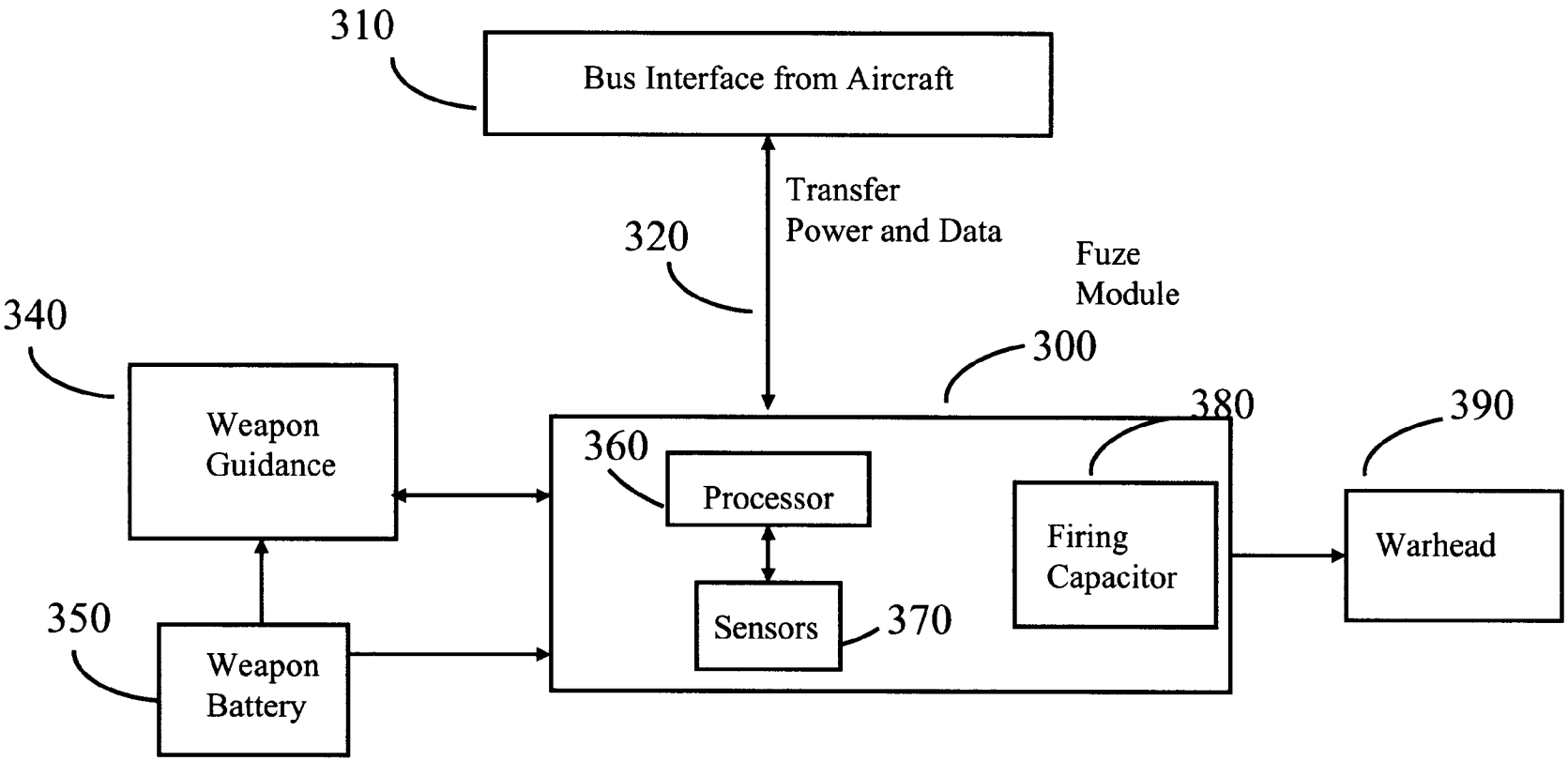
FIG. 3 is a block diagram that illustrates the basic configuration of the fuze module according to an embodiment of the invention.
Figure 4:
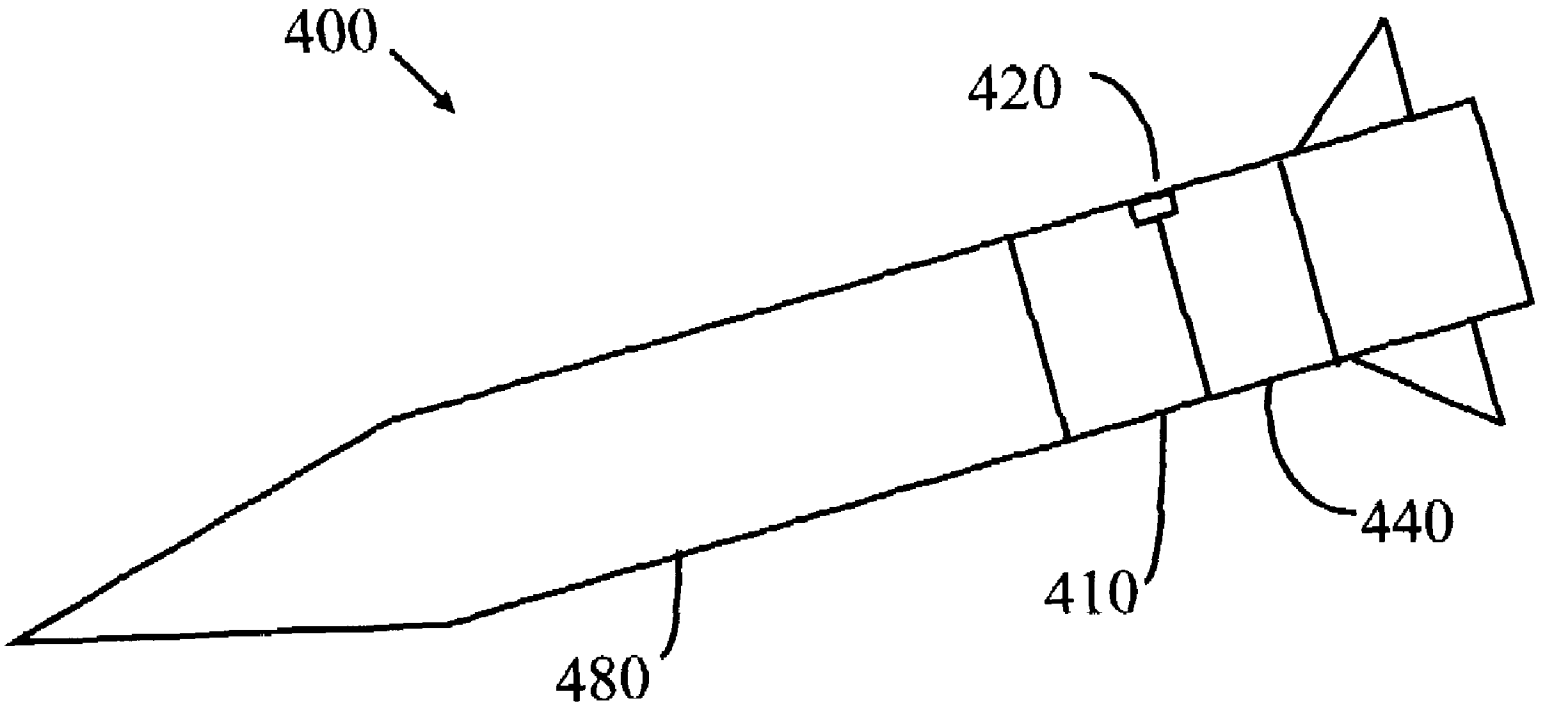
FIG. 4 is an illustration of the location of a fuze module within a weapon according to an embodiment of the invention.

FIGS. 3 and 4 illustrate a basic configuration and a location of a fuze module in a weapon according to embodiments of the invention. A fuze module 300 is connected to a launch vehicle, such as an aircraft, by an umbilical 320 by which power and data is transferred to the weapon 400. The umbilical attachment point 420 allows the coupling of an interface 310, such as a MIL-STD-1553 bus interface, to the weapon 420. Upon the receipt of RC 120 the weapon systems, including guidance 340, shall rely on internal power from the battery 350. The fuze module 300 receives data from guidance 340 such as whether the weapon is in flight. A plurality of sensors 370 within the fuse module 300 interact with the programming in the processor 360. When all required conditions are detected by the sensors 370 the fuze module 300 shall arm, powering the firing capacitor 380, and detonating the warhead 390. In one embodiment shown in FIG. 4, the fuze module 410 is located behind a warhead section 480 and forward of the weapon's guidance system 440.

Another embodiment of the invention includes a method for arming a fuze module in a weapon including: providing a means to transfer data and power between a launch vehicle and the fuze module, a means for operating the fuze module, and a plurality of sensors operatively connected to the means for operating the fuze module; initiating a launch sequence for the weapon containing the fuze module; activating a battery within the weapon to provide a power to the weapon after a launch of the weapon from the launch vehicle; detecting a transfer of a power from a power supply within the launch vehicle to battery within the weapon; launching the weapon from the launch vehicle; disconnecting the means to transfer data and power between the launch vehicle and the fuze module; detecting a peak acceleration profile for the weapon; monitoring an acceleration of the weapon to determine a distance the weapon is from the launch vehicle; receiving a plurality of data from a guidance system on the weapon indicating that the weapon is in flight; and arming the fuze module when the weapon is in flight at a safe distance from the launch vehicle and when the plurality of sensors detect a plurality of conditions are met including the peak acceleration profile for the weapon and indication that the weapon is in flight. In another embodiment of the invention, a method for arming a fuze module in a weapon further includes monitoring a time for the weapon to reach the target or a distance between the weapon and the target and arming the fuze module when the plurality of sensors detects a continuous decrease in the time for the weapon to reach the target or a continuous decrease in the distance between the weapon and the target, indicating that the weapon has been released and is in flight to a target.

It is to be understood that the foregoing detailed description is exemplary and explanatory only and is not to be viewed as being restrictive of embodiments of the invention, as claimed. The invention is capable of other and different embodiments, and its several details are capable of modifications in various obvious respects, all without departing from the invention. Accordingly, the drawings and description are to be regarded as illustrative in nature, and not as restrictive. Thus the scope of this invention should be determined by the appended claims, drawings and their legal equivalents.

What is claimed is:

1. A high reliability fuze module within a weapon comprising:

means to transfer data and power between a launch vehicle and said fuze module that optionally comprises an umbilical having at least one bus;

means for operating said fuze module located within said fuze module;

a plurality of sensors located within said fuze module, said sensors being operatively connected to said means for operating said fuze module;

said fuze module being a sealed unitary structure located within a weapon;

said plurality of sensors detecting a plurality of conditions required for an arming of said weapon;

said means for operating said fuze module receiving a plurality of data from a guidance system on said weapon; and said fuze module being armed by said means for operating said fuze module when analysis of said data indicates a safe separation of said weapon from said launch vehicle, and said sensors detect both a continuous decrease in the time it will take for said weapon to reach a target and a continuous decrease in the distance between said weapon and said target.

2. The fuze module of claim 1, wherein said analysis of said data indicates a safe separation of said weapon from said launch vehicle when an acceleration profile of said weapon matches a valid peak acceleration profile.

3. The fuze module of claim 1, wherein said means for controlling said fuze module renders safe said fuze module after safe separation from said launch vehicle when said sensors detect a non-continuous, excepting non-continuous discrepancies due to re-targeting, decrease in the distance between said weapon and said selected target.

4. The fuze module of claim 1, wherein said means for controlling said fuze module renders safe said fuze module after safe separation from said launch vehicle when said sensors detect a non-continuous, excepting non-continuous discrepancies due to re-targeting, decrease in the time for said weapon to reach said selected target.

5. The fuze module of claim 1 wherein said weapon includes a thermal battery;

said thermal battery being activated within a predetermined period of time after a release consent signal is received by said weapon;

said release consent signal being removed from said weapon when said thermal battery has been activated for a predetermined period of time;

said fuze module being armed by said means for operating said fuze module when analysis of said data indicates a safe separation of said weapon from said launch vehicle, said sensors detect a continuous decrease in the time it will take for said weapon to reach a target, a continuous decrease in the distance between said weapon and said target, or both a decrease in the time it will take for said weapon to reach said target and a continuous decrease in the distance between said weapon and said target, and after said release consent signal has been removed from said weapon.

* * * * *